United States Patent [19]

Allaire

[11] Patent Number: 4,679,697

[45] Date of Patent: Jul. 14, 1987

[54] BOTTLE TOP

[76] Inventor: Eugene J. Allaire, 310-225 East 13th, North Vancouver, British Columbia, Canada, V7L 2L6

[21] Appl. No.: 799,894

[22] Filed: Feb. 18, 1986

[51] Int. Cl.[4] ..... B65D 41/42

[52] U.S. Cl. ..... 215/295; 215/328

[58] Field of Search ..... 215/305, 254, 253, 324, 215/327, 328, 295; 428/64

[56] References Cited

U.S. PATENT DOCUMENTS

| | | | |
|---|---|---|---|
| 868,225 | 10/1907 | Schonert et al. | 215/324 |
| 1,996,554 | 4/1935 | Shearwood | 215/305 |
| 2,156,258 | 5/1939 | Atwood | 215/253 X |
| 3,200,982 | 8/1965 | Cormier | 215/253 |
| 3,269,577 | 8/1966 | Stuart | 215/254 |
| 4,060,172 | 11/1977 | Amabili | 215/295 |

FOREIGN PATENT DOCUMENTS

| | | | |
|---|---|---|---|
| 490664 | 2/1953 | Canada | 215/324 |
| 1123265 | 6/1956 | France | 215/305 |

*Primary Examiner*—Donald F. Norton

*Attorney, Agent, or Firm*—Townsend and Townsend

[57] ABSTRACT

A cap blank for a bottle or jar comprising a disc formed with at least one depression. The depression provides a line of weakness when a cap formed from the blank is installed on a bottle or jar. A cap is also described. The cap can be removed from a bottle or jar by hand and is installed on conventional equipment for crimped tops, in the case of a bottle, or by hand or by conventional equipment for a jar.

8 Claims, 11 Drawing Figures

BOTTLE TOP

FIELD OF THE INVENTION

This invention relates to a cap blank and to a cap formed from the blank. The cap finds particular application in providing an easily removed, yet gasproof, cap for beer bottles and in providing resealable caps for jars.

DESCRIPTION OF THE PRIOR ART

For many years the only type of cap available on beer bottles and the like gaseous drinks was the crimp top. Such a top comprised a flat metal disc with a downwardly extending skirt crimped tightly around the neck of the bottle, so tightly that the cap could only be removed using a bottle opener. The opener comprises a simple lever. The cap could not be removed by hand. However the recent trend has been to twist caps in which a gas tight cap is provided but in which the cap can be easily removed by simple twisting. The obvious advantage of such an arrangement is, of course, that no bottle opener is required; it is merely necessary to twist the cap by hand to remove it.

A further drawback of present twist tops is that the 'break-legs' between upper and lower sections of the cap have proven in too many instances difficult to break, particularly for women and children. Weaker 'break-legs' are not sufficiently strong to resist internal pressure of the bottle contents. These twist tops require special bottles, that is bottles having necks different from the millions of bottles already in circulation and adapted to receive the conventional crimped bottle top. Furthermore the equipment required to install these twist caps is different from the equipment necessary to install the crimped bottle top and the changing of a production line in a brewery, or indeed in any bottling plant, represents a major expense, both in installing the equipment and in the inconvenience and possible stopping of the existing production line.

In the case of jars, for example, for jam, pickles and the like, the existing lids are relatively complicated structures. They must be able to seal the jar from the factory to the user and, in many cases, once the lid has been removed. That is the sealing ability must remain even though the cap is removed and replaced. Typically such a lid must have some sort of threaded attachment to provide the necessary seal or they are of metal with bosses to grip the container. The forming of a thread on a glass or plastic container adds considerably to its expense but simple push-on tops have not been able to provide an adequate seal in that once removed they are distorted so that re-capping is unsatisfactory. They also do not show signs of tampering.

SUMMARY OF THE INVENTION

Accordingly the present invention seeks to provide a cap that does not require modification of the existing bottle or jar, that is the bottle adapted to receive a non-threaded top, and yet can be removed by hand. Furthermore the cap can be applied in the brewery or bottling plant on known equipment used in applying crimped caps or simple push-on caps.

Accordingly, in its broadest aspect, the present invention is a cap blank comprising a disc formed with at least one depression, said depression providing a line of weakness when a cap formed from the blank is installed on a bottle.

In one embodiment the present invention provides a cap comprising a generally flat portion with a skirt extending downwardly from the flat portion and adapted to be crimped onto a bottle; a plurality of depressions arranged within the cap and providing lines of weakness in the cap to facilitate bending, and thus release, of the cap after the cap is installed on a bottle.

In a further embodiment, there is provided a jar top for a jar with an outwardly extending rim, the jar top comprising a generally flat portion with a skirt extending downwardly from the flat portion; a depression in the flat portion to provide a line of weakness in the cap to facilitate bending; an inwardly extending flange at the end of the skirt, remote from the flat portion to grip the underside of the jar rim to force the flat portion downwardly to seal against the jar top; a tab extending outwardly from the base of the skirt to permit gripping and distortion of the top to remove it.

DRAWINGS

Aspects of the invention are illustrated, merely by way of example, in the accompanying drawings in which FIG. 1 is a perspective view of a blank according to the present invention;

DESCRIPTION OF THE PREFERRED EMBODIMENTS

Figure 1:
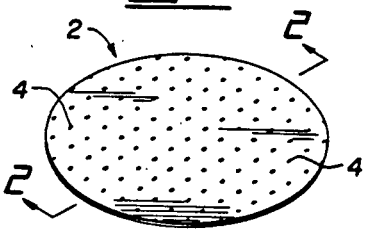
Figure 2:
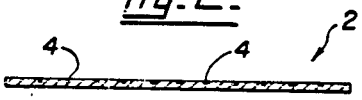
FIG. 2 is a section on the line 2—2 in FIG. 1.
Figure 3:
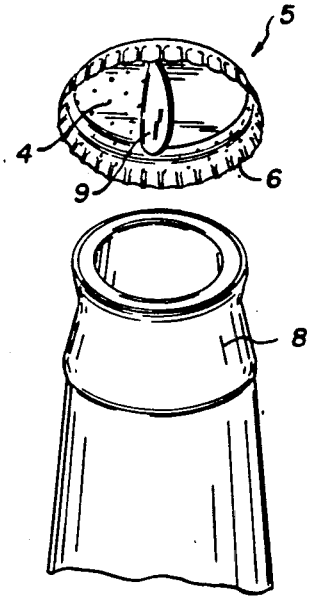
FIG. 3 is a perspective view showing a cap made from the blank of FIG. 1.

FIGS. 1 to 3 show a blank comprising a disc 2 having a plurality of depressions 4 formed on it. The depressions 4 may be applied by simple punch equipment and generally extend about one third of the way into the disc, as shown in FIG. 2. The pattern of depressions may be entirely random but, in a preferred embodiment, the depressions are arranged in regular lines, as shown in FIG. 1, with each depression about ¼" from its straight line neighbour.

FIG. 3 illustrates a cap 5 according to the present invention made from the blank of FIG. 1. The cap is installed using conventional equipment. Desirably the disc 2 of FIG. 1 is first formed with a skirt 6, extending downwardly from the disc 2 and the skirted disc is installed on a bottle neck 8 immediately prior to the bottle, with the disc resting on it, passes through a crimping machine to crimp the cap in the position shown in FIG. 3. The depressions 4 are on the inside of the cap. The cap 5 has a conventional plastic insert 9, shown partially folded away in FIG. 3 to display depressions 4. The insert 9 is not essential.

The top of the embodiment of FIGS. 1 to 3, is removed as follows: a bottle is supported against a smooth surface, abutting the portion of the cap 5 projecting beyond the neck 8 of the bottle and gentle pressure is applied, for example with the heel of the hand to the top of the bottle. The depressions 4 form lines of weakness around which the cap 5 can easily bend. Once bent the cap 5 can be peeled from the bottle by hand.

Figure 4:
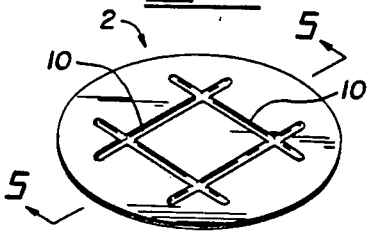
FIG. 4 is a perspective view of a further blank according to the present invention.
Figure 5:
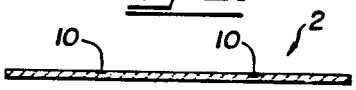
FIG. 5 is a view on the line 5—5 in FIG. 4.
Figure 6:
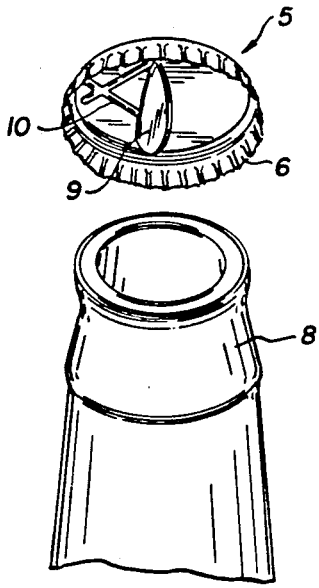
FIG. 6 shows a cap made from the blank of FIG. 4 installed on a bottle.

FIG. 4 illustrates a variation of the embodiment of FIG. 1 in which the depressions 4 of FIG. 1 are replaced by lines 10. As shown particularly in FIG. 6 the lines are arranged on the blanks so that each is one or more lines on the inside of the finished cap. The installation and use of the embodiment of FIGS. 4 to 6 is precisely the same as in FIGS. 1 to 3, that is conventional equipment is used to install the cap and simple hand removal is sufficient. The lines 10, of course, form the necessary lines of weakness around which the cap can bend.

The caps of the present invention may be made of aluminum or steel or, indeed, any other material acceptable under the law for bottle caps.

In all embodiments the depressions 10, 32 and 4 shall not extend beyond the inside diameter of the cap as leaks will result.

Tests conducted with a cap according to the present invention showed that the bottle will burst, at a pressure of about 120 pounds per square inch, before the cap can be removed.

If desired the depressions may spell the name of an advertiser or, of course, the bottler of the beer.

Figure 7:
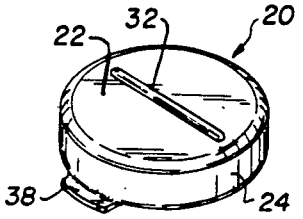
FIG. 7 is a perspective view of a further embodiment of the invention.

FIG. 7 shows a simple press-fit bottle top 20 having generally flat portion 22. There is a skirt 24 extending down from portion 22. As shown in FIG. 9 the top 20 fits on a jar 26 formed with top 28 and an outwardly extending rim 30. Depression 32 is formed in top 20. The cap may also have a conventional liner 34, folded away in FIGS. 8 and 10 to show depression 32. There is an inwardly extending flange shown, in FIG. 8, to comprise discrete tabs 36, which grip the rim 30 to form a seal at the top 28 of the jar 26. The cap 20 has an outwardly extending tab 38 so that the lip may be gripped and removed from the jar 26. Points of weakness 40 are formed just ahead of the depression 32, on the tab side of the depression.

To use the cap of FIG. 7 it is simply pressed on jar 26. Tabs 36 grip rim 30 to force and keep the flat portion 22, and liner 34, down onto rim 30. To remove the top 20 tab 38 is gripped. Its initial upward movement is facilitated by weakness points 40 and the bending to remove by depression 32. The top 22 is reusable as it may simply be pushed onto rim 28. Depression 32 allows straightening of the top and any tears that may have formed at 40 are not important as the seal is formed at the top of the rim 28.

Figure 8:
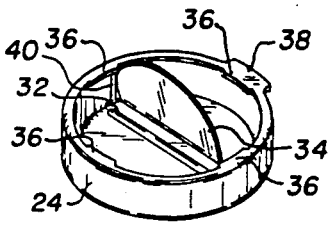
FIG. 8 is a view of the inside of the embodiment of FIG. 7.
Figure 9:
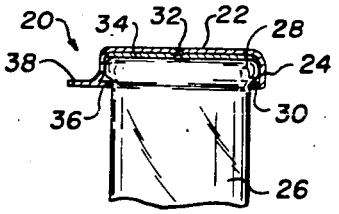
FIG. 9 is a section showing the embodiment of FIG. 7 in position.
Figure 10:
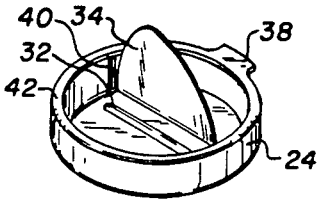
FIG. 10 is an inside view of a variation of the embodiment of FIG. 7.

The FIG. 10 embodiment differs from that of FIG. 8 only by the presence of continuous, inwardly extending flange 42 in place of tabs 36.

Figure 11:
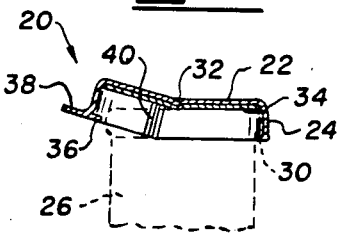
FIG. 11 shows a cap partially removed.

FIG. 11 simply shows the partial removal of a cap. It should be noted that bending of the cap occurs about depression 32 and stretching about weakness points 40. The stretching at points 40 leaves a mark to indicate the cap has been removed at least once.

The present invention thus provides a simple, cheap bottle or jar cap that can be installed using existing equipment and can be removed by hand. The new equipment necessary for twist caps is not necessary. With the embodiments of FIGS. 7 to 10 tell-tale distortion of the cap shows it has been removed. This can be used as an indication of tampering in a store. The caps are also child-proof principally because of the strength of the grip of the cap but also because tampering is apparent, acting to deter the effort.

I claim:

1. A bottle cap comprising a generally flat portion with a skirt extending downwardly from the flat portion and adapted to be crimped onto a bottle;

a plurality of depressions arranged on the interior of the flat portion of the cap, extending about one third through the thickness of the cap and providing lines of weakness in the cap to facilitate bending, and thus release, of the cap when the cap is installed on a bottle.

2. A bottle cap as claimed in claim 1 of steel, aluminum or plastic.

3. A bottle cap as claimed in claim 1 in which the depressions comprise a regular pattern of at least one straight line of discrete dots, each dot being at about one quarter inch from its straight line neighbouring dots.

4. A bottle cap as claimed in claim 1 in which the depressions comprise a plurality of lines, each line generally defining a chord on the top of the cap.

5. A jar top for a jar with an outwardly extending rim, the jar top comprising a generally flat portion with a skirt extending downwardly from the flat portion; a depression in the flat portion to provide a line of weakness in the cap to facilitate bending; an inwardly extending flange at the end of the skirt, remote from the flat portion to grip the underside of the jar rim to force the flat portion downwardly to seal against the jar top; a tab extending outwardly from the base of the skirt to permit gripping and distortion of the top to remove it.

6. A jar top as claimed in claim 5 in which at least two points of weakness are formed around the circumference of the skirt, to facilitate removal of the jar top.

7. A jar top as claimed in claim 5 in which the inwardly extending flange comprises discrete tabs about the inner periphery of the skirt.

8. A jar top as claimed in claim 5 in which the inwardly extending flange is continuous.

* * * * *